US009945606B2

(12) United States Patent
Le Bot et al.

(10) Patent No.: US 9,945,606 B2
(45) Date of Patent: Apr. 17, 2018

(54) METHOD AND SYSTEM FOR THE PRODUCTION OF PRESSURIZED AIR GAS BY CRYOGENIC DISTILLATION OF AIR

(75) Inventors: Patrick Le Bot, Vincennes (FR); Olivier De Cayeux, Paris (FR); Frédéric Judas, Chatenay-Malabry (FR)

(73) Assignee: L'AIR LIQUIDE SOCIETE ANONYME POUR L'ETUDE ET L'EXPLOITATION DES PROCEDES GEORGES CLAUDE, Paris (FR)

( * ) Notice: Subject to any disclaimer, the term of this patent is extended or adjusted under 35 U.S.C. 154(b) by 663 days.

(21) Appl. No.: 10/555,745

(22) PCT Filed: Apr. 6, 2004

(86) PCT No.: PCT/FR2004/050146
§ 371 (c)(1),
(2), (4) Date: Nov. 4, 2005

(87) PCT Pub. No.: WO2004/099691
PCT Pub. Date: Nov. 18, 2004

(65) Prior Publication Data

US 2006/0277944 A1 Dec. 14, 2006

(30) Foreign Application Priority Data

May 5, 2003 (FR) ..... 03 50142

(51) Int. Cl.
*F25J 3/04* (2006.01)

(52) U.S. Cl.
CPC ..... *F25J 3/04296* (2013.01); *F25J 3/0409* (2013.01); *F25J 3/04054* (2013.01);
(Continued)

(58) Field of Classification Search
CPC .. F25J 3/04296; F25J 2240/12; F25J 3/04048; F25J 3/04054
See application file for complete search history.

(56) References Cited

U.S. PATENT DOCUMENTS 3,285,028 A * 11/1966 Newton ..... F25B 9/004 62/117
3,605,422 A * 9/1971 Pryor ..... F25J 3/04224 62/650

(Continued)

FOREIGN PATENT DOCUMENTS

DE 199 51 521 5/2001
EP 0 504 029 9/1992

(Continued)

OTHER PUBLICATIONS

International Search Report for PCT/FR2004/050146.

*Primary Examiner* — John F Pettitt
(74) *Attorney, Agent, or Firm* — Justin K. Murray

(57) ABSTRACT

Methods and apparatus for cryogenic distillation of air. In a system of air separation columns, all the air is taken to a high pressure which is 5 to 10 bar greater than a medium pressure. A portion of air, between 10% and 50% of the high pressure air stream, is boosted in a cold booster. This boosted air is then sent to an exchanger and a portion of it liquefies at the cold end of the exchanger. Part of the air is sent to one column of the column system, and another fraction is partly expanded in a Claude turbine. After expansion in the turbine, the air is sent to a medium pressure column, and a liquid stream is withdrawn for one of the columns of the system. The withdrawn stream is pressurized and vaporizes in the exchange line. The cold booster is coupled to either an expansion turbine, an electric motor, or a combination of the two.

17 Claims, 4 Drawing Sheets

(52) U.S. Cl.
CPC ..... *F25J 3/04175* (2013.01); *F25J 3/04303* (2013.01); *F25J 3/04309* (2013.01); *F25J 3/04393* (2013.01); *F25J 3/04412* (2013.01); *F25J 2240/42* (2013.01)

(56) References Cited

U.S. PATENT DOCUMENTS

| | | | | | |
|---|---|---|---|---|---|
| 4,303,428 | A * | 12/1981 | Vandenbussche | ..... | 62/646 |
| 4,869,742 | A * | 9/1989 | Thorogood | ..... F25J 3/04193 | 62/652 |
| 5,329,776 | A * | 7/1994 | Grenier | ..... | 62/646 |
| 5,400,600 | A * | 3/1995 | Grenier | ..... | 62/646 |
| 5,475,980 | A * | 12/1995 | Grenier et al. | ..... | 62/646 |
| 5,515,687 | A * | 5/1996 | Arriulou | ..... F25J 3/0409 | 62/646 |
| 5,596,885 | A * | 1/1997 | Grenier | ..... | 62/646 |
| 5,941,098 | A * | 8/1999 | Guillard | ..... F25J 3/0403 | 62/656 |
| 6,253,576 | B1 * | 7/2001 | Herron et al. | ..... | 62/646 |
| 6,336,345 | B1 | 1/2002 | Corduan | | |
| 2005/0126221 | A1 * | 6/2005 | Ha | ..... F25J 3/04024 | 62/643 |

FOREIGN PATENT DOCUMENTS

| | | |
|---|---|---|
| EP | 0 644 388 | 3/1995 |
| EP | 0 932 000 | 7/1999 |

* cited by examiner

METHOD AND SYSTEM FOR THE PRODUCTION OF PRESSURIZED AIR GAS BY CRYOGENIC DISTILLATION OF AIR

BACKGROUND

The present invention relates to a process and to a plant for producing pressurized air gases by cryogenic air distillation.

Certain (type 1) processes, such as those described in EP-A-0 504 029, produce oxygen at high pressure (>15 bar) using a single compressor to compress the air to a pressure well above the pressure of the medium-pressure column.

These processes are suitable for a context in which investment costs are of prime importance, as they have the drawback of consuming a very large amount of energy when no liquid production is required.

Other (type 2) processes, using a high air pressure only for producing pressurized gaseous oxygen, are disclosed in U.S. Pat. No. 5,475,980 and have a better specific energy for producing gaseous oxygen at high pressure, without producing liquid (or with a low production of liquid). They use cryogenic compression of air pressurized by means of a blower mechanically linked to an expansion turbine.

However, this energy advantage is counterbalanced by an investment substantially greater than that of type 1, as this is an expensive process in terms of exchanger volume. This is because in general a large fraction (60% to 80%) of the main air stream undergoes adiabatic cryogenic compression before being reintroduced into the main exchange line.

Finally, these types of process seem to be economically advantageous, and the choice will depend on the intended utilization of the energy, available at low or high cost.

In this document, the term "condensation" includes pseudo-condensation and the term "vaporization" includes pseudo-vaporization.

Temperatures are considered as being similar if they differ by at most 10° C., preferably at most 5° C.

The exchange line is the main exchanger where the gases produced by the column system are warmed and/or where the air intended for distillation is cooled.

SUMMARY

The invention includes both methods and apparatus to achieve the desired results, as described, but is not limited to the various embodiments disclosed.

It is an object of the invention to propose an alternative for producing process schemes allowing the energy performance to be improved over type-1 processes, while retaining an exchange volume requirement of less than that of cold-compression, type-2 schemes, as described above.

According to the invention, only a fraction of the air (the fraction that liquefies at the cold end) undergoes cryogenic compression, which minimizes the increase in volume of the exchanger. However, this allows the main air pressure to be very substantially reduced, since the air output by the cryogenic booster remains at a pressure sufficient to vaporize oxygen.

One of the objects of the invention is to provide a process for separating air by cryogenic distillation in a system of columns, comprising a double column or a triple column, the column operating at the highest pressure operating at a pressure called medium pressure, in which:

a) all the air is raised to a high pressure at least 5 to 10 bar above the medium pressure;

b) a portion of the air, comprising between 10% and 50% of the flow of air at high pressure, is withdrawn from an exchange line at a temperature close to the (pseudo) vaporization temperature of the liquid, boosted to above at least the high pressure by means of a cold booster and then sent back into the exchange line, and at least one portion liquefies at the cold end and is then sent, after expansion, into at least one column of the column system;

c) another fraction of the air at at least the high pressure, possibly constituting the remainder of the high-pressure air, is expanded in a Claude turbine and then sent into the medium-pressure column;

d) at least one liquid stream is withdrawn from one of the columns of the column system, pressurized, and vaporized in the exchange line; and e) the cold booster is coupled to one of the following drive devices:

i) an expansion turbine, ii) an electric motor or iii) a combination of an expansion turbine and an electric motor.

BRIEF DESCRIPTION OF THE DRAWINGS

For a further understanding of the nature and objects for the present invention, reference should be made to the following detailed description, taken in conjunction with the accompanying drawings, in which like elements are given the same or analogous reference numbers and wherein.

DESCRIPTION OF PREFERRED EMBODIMENTS

Figure 1:
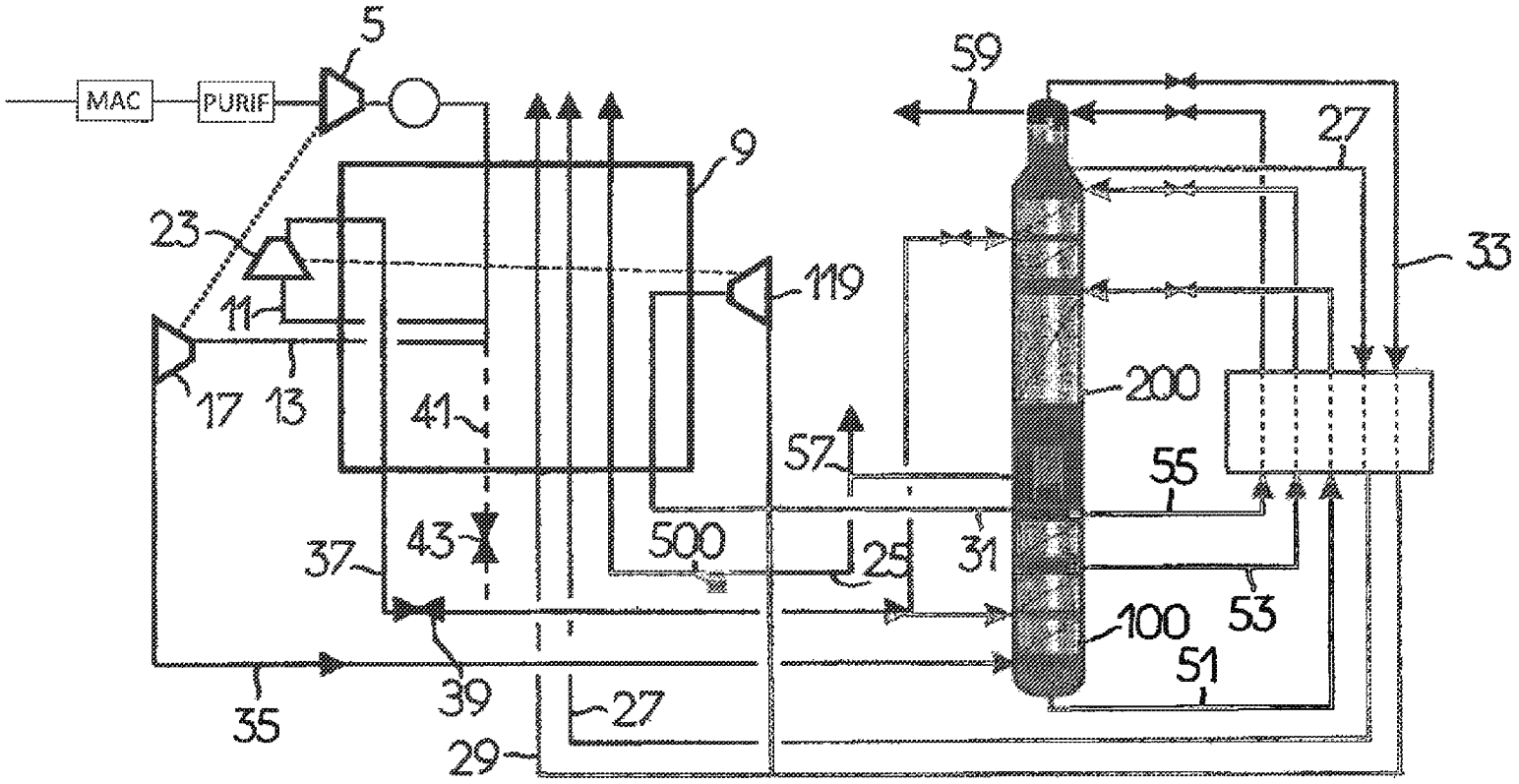
FIG. 1 illustrates a schematic representation of one embodiment, according to the present invention, of an air separation unit.

The invention includes methods and apparatus for the cryogenic separation of air, as described above.

According to other, optional aspects:

at least one portion of the high-pressure air is boosted, before entering the main exchange line, in a hot booster and then cooled in the exchange line;

all the air to be distilled is boosted to a pressure above the high pressure in the hot booster;

a portion of the air coming from the hot booster is sent to the Claude turbine at the outlet pressure of the hot booster;

a portion of the air coming from the hot booster is cooled in the exchange line, is expanded and liquefied, and sent to at least one column of the column system;

all the air coming from the hot booster is sent only to the Claude turbine or to the Claude turbine and to the cold booster;

the hot booster is coupled to the Claude turbine;

all the gaseous air intended for distillation comes from the turbine and optionally from another air expansion turbine;

all the air boosted in the cold booster is cooled in the exchange line, expanded and liquefied, and sent to at least one column of the column system;

a nitrogen-enriched gas stream coming from a column of the column system is slightly warmed in the exchange line, expanded in the expansion turbine constituting (or forming part of) the drive device and warmed in the exchange line;

a stream of air is expanded in the expansion turbine constituting (or forming part of) the drive device and the expanded air is sent to a column of the column system, in particular to the low-pressure column;

the liquid coming from the column, which vaporizes, is oxygen-enriched compared with air;

the intake temperature of the cold booster is close and preferably substantially equal to the vaporization temperature of the liquid withdrawn from the columns and is introduced, pressurized, into the exchange line;

the intake temperature of the Claude turbine is below the intake temperature of the cold booster;

the intake temperature of the turbine constituting, or forming part of, the drive device is above the intake temperature of the cold booster; and all the air raised to a high pressure at least 5 to 10 bar above the medium pressure is purified at this high pressure.

Another object of the invention is to provide a cryogenic-distillation air-separation plant comprising:

a) a heat exchange line;

b) a double or triple air-separation column, of which the column operating at the highest pressure operates at a medium pressure;

c) a Claude turbine;

d) a hot booster coupled to the Claude turbine;

e) a cold booster;

f) a device for driving the cold booster, consisting of a turbine, an electric motor or a combination of the two;

g) means for sending all the compressed air intended for distillation to the hot booster and means for sending the boosted air to the heat exchange line;

h) means for withdrawing a first portion of the boosted air to an intermediate level of the exchange line, preferably constituting between 10 and 50% of the compressed air, and for sending it to the cold booster, means for sending the air coming from the cold booster back to the exchange line, and means for outputting the air coming from the cold booster from the cold end of the exchange line, in order to expand it and to send it on;

i) means for withdrawing a second portion of the boosted air to an intermediate level of the exchange line and for sending it to the Claude turbine; and j) means for sending a liquid to be vaporized from the double or triple column into the exchange line.

The turbine constituting the drive device or forming part of the latter may be an air expansion turbine, in particular a blowing turbine or a nitrogen expansion turbine.

The turbine constituting the drive device or forming part of the latter may be an air expansion turbine, in particular a blowing turbine or a nitrogen expansion turbine.

The invention will be described in greater detail with respect to the drawings, FIGS. 1 to 4 of which each show an air-separation unit according to the invention. In FIG. 1, air is compressed to a pressure of about 15 bar in a compressor MAC and then purified in order to remove the impurities PURIF. The purified air is boosted to a pressure of about 18 bar in a booster 5. The boosted air is cooled by heat exchange with a refrigerant, such as water, and is sent to the warm end of the exchange line 9. All the air is cooled down to an intermediate temperature of the exchange line and then the air is divided into two. A first portion 11 of the air, comprising between 10 and 50% of the high-pressure air stream, is sent to a booster 23 intaking at a cryogenic temperature. The boosted air is then sent to the exchange line, without being cooled at the outlet of the booster, at a pressure of about 31 bar, continues to be cooled and liquefies, in particular by heat exchange with a pumped stream of liquid oxygen 25, which pseudo-vaporizes. The remainder 13 of the air, comprising between 50 and 90% of the high-pressure air, is cooled to a temperature lower than the intake temperature of the booster 23, is expanded in a Claude turbine 17 and sent to the medium-pressure column, thus constituting the sole gaseous air stream sent to the double column.

A nitrogen-enriched gas stream 31, coming from the medium-pressure column 100, is warmed in the exchange line, exits therefrom at a temperature higher than the inlet temperature of the Claude turbine 17, and is sent to an expansion turbine 119. The nitrogen expanded substantially at the low pressure and substantially at the temperature of the cold end of the exchange line is reintroduced into the exchange line, where it warms up or joins a nitrogen-enriched gas 33 withdrawn from the low-pressure column, and the nitrogen stream 29 formed is warmed while passing through the entire exchange line.

The nitrogen turbine 119 is coupled to the cold booster 23, while the Claude turbine 17 is coupled to the hot booster 5.

The expansion turbine 119 is not an essential element of the invention and the drive for the cold booster 23 may be replaced by an electric motor. Likewise, the expansion turbine 119 may be replaced with an air-expansion turbine.

The column system of FIG. 1, and of all the figures, is a conventional air-separation unit formed by a medium-pressure column 100 thermally coupled to the low-pressure column 200 by means of a sump reboiler of the low-pressure column, the reboiler being warmed by a stream of medium-pressure nitrogen. Other types of reboiler may of course be envisaged.

The medium-pressure column 100 operates at a pressure of 5.5 bar, but it may operate at higher pressure.

The gaseous air 35 coming from the turbine 17 is sent into the bottom of the medium-pressure column 100.

The liquefied air 37 is expanded in the valve 39 and divided into two, one portion being sent to the medium-pressure column 100 and the remainder to the low-pressure column 200.

Rich liquid 51, lower lean liquid 53 and upper lean liquid 55 are sent from the medium-pressure column 100 into the low-pressure column 200 after in-valve expansion and subcooling steps.

Oxygen-enriched liquid 57 and nitrogen-enriched liquid 59 are possibly withdrawn from the double column as final products.

Oxygen-enriched liquid is pressurized by the pump 500 and sent, as pressurized liquid 25, towards the exchange line 9. Alternatively or additionally, other, pressurized or non-pressurized, liquids, such as other liquid oxygen streams at a different pressure, liquid nitrogen and liquid argon, may be vaporized in the exchange line 9.

Waste nitrogen 27 is withdrawn from the top of the low-pressure column and is warmed in the exchange line 9, after having been used to subcool the reflux liquids 51, 53, 55.

The column may optionally produce argon by treating a stream withdrawn from the low-pressure column 200.

As a variant, as shown in dotted lines, a portion 41 of the high-pressure air, not boosted in the booster 23, may liquefy in the exchange line by heat exchange with the oxygen, which vaporizes, is expanded in a valve 43 down to the medium pressure, and is mixed with the liquefied air 37. It will be understood that if the air is at a supercritical pressure on leaving the booster 5 liquefaction will take place only after expansion in the valves 39, 43.

Figure 2:
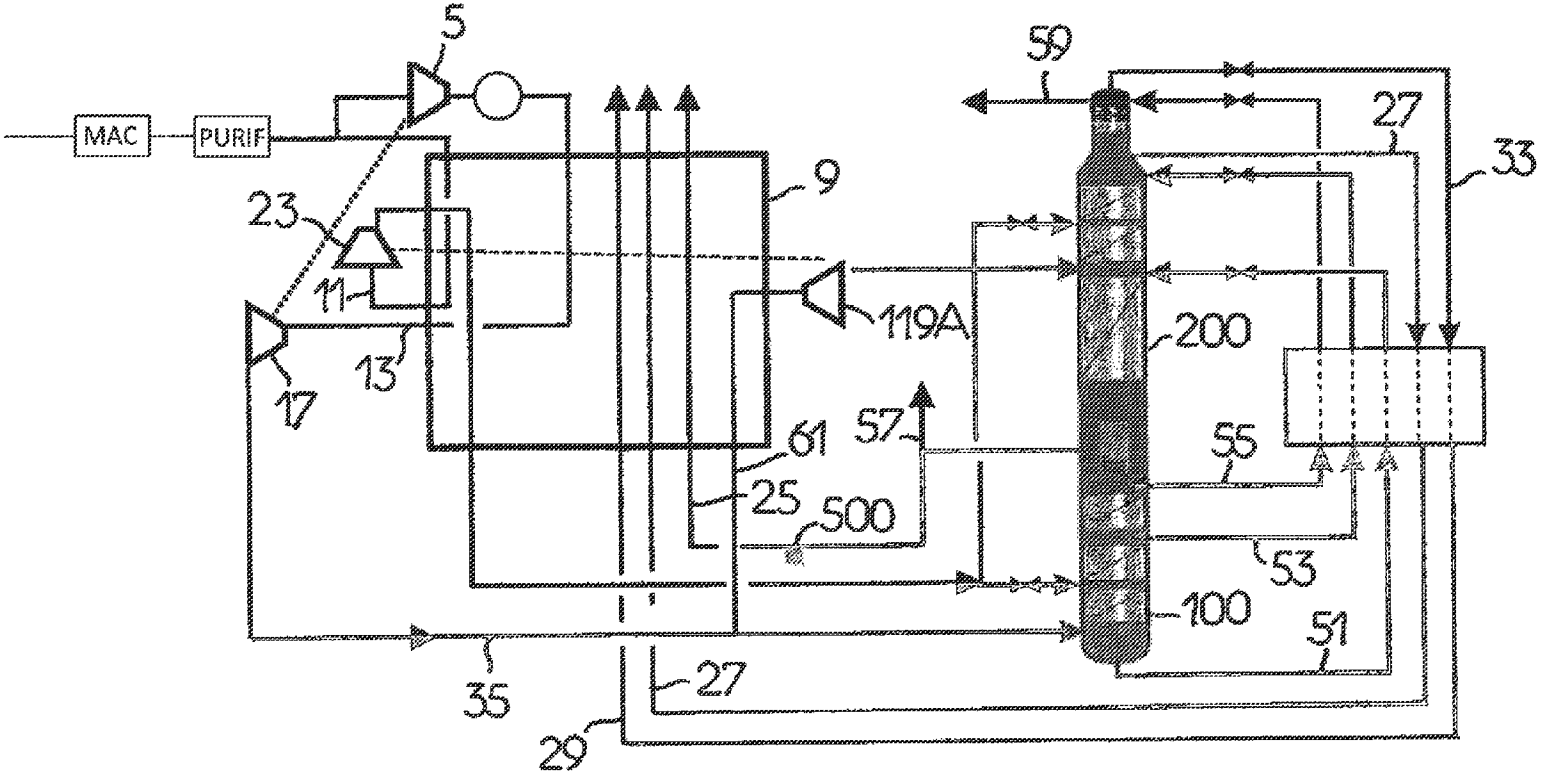
FIG. 2 illustrates a schematic representation of another embodiment, according to the present invention, of an air separation unit.

FIG. 2 differs from FIG. 1 in that there is no withdrawal of gaseous medium-pressure nitrogen from the top of the medium-pressure column 100. The medium-pressure nitrogen turbine 119 is replaced by a blowing turbine 119A. A portion 61 of the air coming from the Claude turbine 17 is sent to the blowing turbine and the air expanded in the turbine 119A is sent to the low-pressure column 200.

The hot booster 5 is again coupled to the Claude turbine, but the cold booster 23 is coupled to the blowing turbine.

The liquid-air expansion valves are also different in FIG. 2 because the liquid streams are expanded only after division to form the streams intended for the medium-pressure and low-pressure columns.

As in FIG. 1, it is possible to cool a portion of the high-pressure air by heat exchange with oxygen, in such a way that two air streams liquefy in the exchange line, allowing the heat balance to be optimized.

This kind of process is more suitable for the production of low-purity oxygen.

Figure 3:
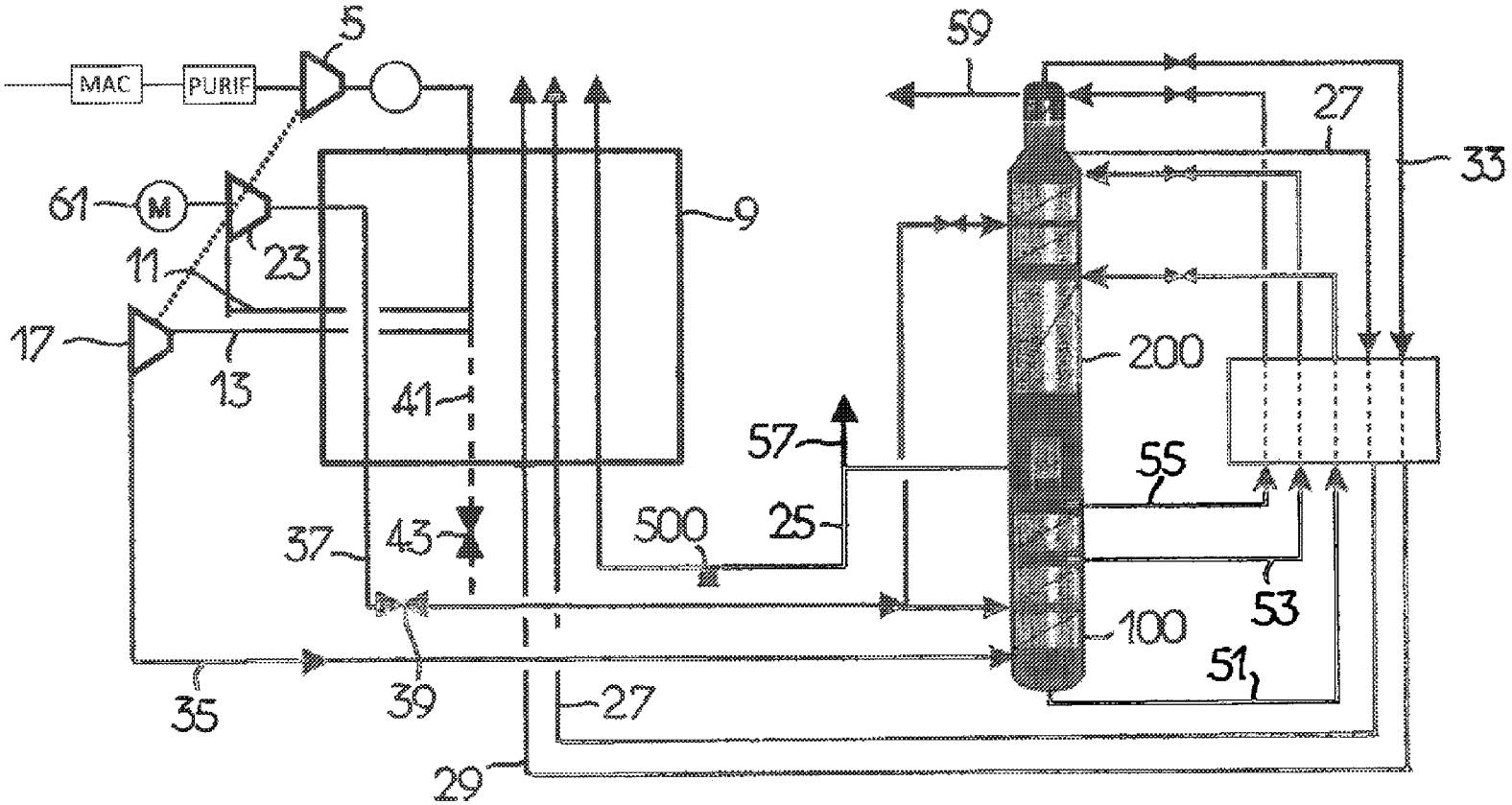
FIG. 3 illustrates a schematic representation of a third embodiment, according to the present invention, of an air separation unit.

FIG. 3 resembles FIGS. 1 and 2, but it includes no turbine, except the Claude turbine. The cold booster 23 is coupled to a motor 61 and the hot booster 5 is coupled to the Claude turbine.

Figure 4:
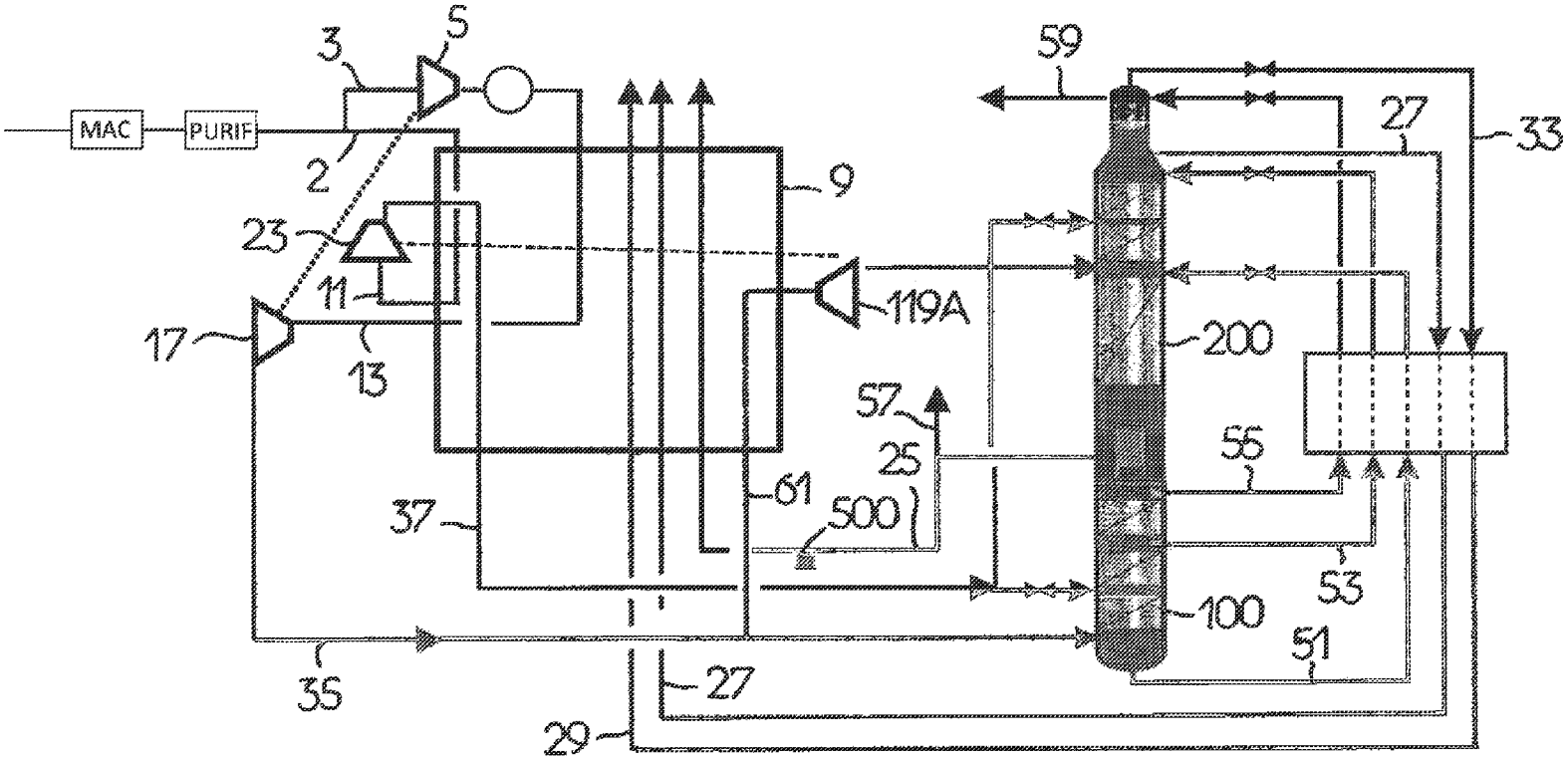
FIG. 4 illustrates a schematic representation of a fourth embodiment, according to the present invention, of an air separation unit.

In FIG. 4, only a portion 3 of the compressed air at approximately 15 bar is sent to the hot booster 5. This portion constitutes between 90 and 50% of the high-pressure air. This air is then cooled and sent to the warm end of the exchange line 9. All the air coming from the hot booster is withdrawn to an intermediate level of the exchange line 9 and sent to the Claude turbine 17. A portion of the expanded air 35 is sent direction to the medium-pressure column 100, while the remainder of the expanded air is sent to a blowing turbine 119A and then to the low-pressure column 200.

The remaining portion 2 of the air at about 15 bar (and therefore between 10 and 50% of the total high-pressure flow) is cooled in the exchange line 9 down to an intermediate temperature above the intake temperature of the Claude turbine 17 and is then boosted in the cold booster 23. This air then liquefies in the exchange line 9. As in FIG. 2, the hot booster 5 is coupled to the Claude turbine and the cold booster 23 is coupled to the blowing turbine 119A.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A method for separating air by cryogenic distillation in a system of columns, said method comprising the steps of:

a) providing the system of columns comprising a double column having a low pressure column and a medium pressure column, wherein the medium pressure column is operating at a pressure called medium pressure;

b) compressing air to a high pressure using a main air compressor to form a high pressure air, wherein said high pressure is at least 5 bar greater than said medium pressure;

c) boosting all of the high pressure air, with a hot booster, to a second pressure greater than said high pressure;

d) introducing the high pressure air at the second pressure to a warm end of exchange line;

e) withdrawing a first portion of said high pressure air from the exchange line, wherein:

1) said first portion comprises between 10% to 50% of said high pressure air; and 2) said first portion is withdrawn at a temperature within 10° C. of a liquid vaporization temperature;

f) boosting, with a cold booster, said first portion to at least said high pressure, wherein:

1) said cold booster is mechanically coupled with a drive device; and 2) said drive device comprises at least one member selected from the group consisting of:

i) an expansion turbine;

ii) an electric motor; and iii) a combination expansion turbine and electric motor;

g) sending said boosted first portion back into said exchange line for liquefaction therein;

h) sending at least one liquefied portion of said boosted first portion from a cold end of said exchange line to at least one column of said system;

i) expanding a second portion of said high pressure air in a Claude turbine, wherein said second portion is at least a part of the portion of said high pressure air that is remaining after said first portion is withdrawn from said high pressure air, and sending said expanded second portion to the medium pressure column; and j) withdrawing at least one liquid stream from said column system.

2. The method of claim 1, wherein all said high pressure air from said hot booster is sent to either said Claude turbine or to said cold booster, such that the first portion is sent to the cold booster and the second portion is sent to the Claude turbine.

3. The method of claim 1, wherein said hot booster is mechanically coupled to said Claude turbine.

4. The method of claim 1, wherein the high pressure air consists of the first portion and the second portion.

5. The method of claim 1, wherein the boosted first portion is cooled within the exchange line at an output pressure of the cold booster.

6. The method of claim 1, wherein the boosted first portion is liquefied in step g) at an exit pressure of the cold booster and is sent to the double column without being expanded in a Claude turbine.

7. The method of claim 1, wherein the process comprises an absence of expanding a stream in the Claude turbine that has already been compressed in the cold booster.

8. The method of claim 1, wherein the high pressure air further comprises a third portion, wherein said third portion is cooled within the exchange line at the second pressure, wherein the third portion is withdrawn from the exchange line, expanded and liquefied before sending said third portion to the system of columns.

9. The method of claim 1, wherein the only stream having the composition of air that is sent to the double column in gaseous form is the expanded second portion.

10. The method of claim 1, further comprising:

a) partially warming a nitrogen enriched gas stream from said medium pressure column in said exchange line;

b) expanding said nitrogen enriched gas stream in said expansion turbine; and c) further warming said stream in said exchange line.

11. The method of claim 1, wherein said liquid stream of step j) is oxygen enriched compared to air.

12. The method of claim 1, wherein said cold booster's intake temperature is similar to said liquid stream's vaporization temperature.

13. The method of claim 1, wherein said cold booster has an intake temperature that is greater than an intake temperature of said Claude turbine.

14. The method of claim 1, wherein said expansion turbine has an intake temperature that is greater than an intake temperature said Claude turbine.

15. The method of claim 1, wherein the expanded second portion that was expanded in the Claude turbine and sent to the medium pressure column in step i) constitutes the sole gaseous air stream sent to the double column.

16. A process for separating air by cryogenic distillation in a system of columns, the method comprising the steps of:

a) providing the system of columns, wherein the system of columns comprises a double column having a low pressure column and a medium pressure column, wherein the medium pressure column operates at a medium pressure $P_M$;

b) raising air to an initial pressure $P_i$ that is at least 5 bar above the $P_M$ to form a high pressure air;

c) introducing the high pressure air to an exchange line for cooling therein;

d) withdrawing a first portion of said high pressure air from an intermediate location of the exchange line, wherein:

1) said first portion comprises between 10% to 50% of said high pressure air, and 2) said first portion is withdrawn at a temperature $T_1$, wherein $T_1$ is within 5° C. of a vaporization temperature of a liquid stream vaporizing in the exchange line;

e) boosting, with a cold booster, said first portion to a boosted pressure $P_B$ that is above $P_i$ to form a boosted air portion;

f) reintroducing the boosted air portion to the exchange line at a second intermediate location at a temperature warmer than $T_1$ and liquefying the boosted air portion within the exchange line to form a liquefied first portion;

g) withdrawing the liquefied first portion from the exchange line, expanding said liquefied first portion and sending said liquefied first portion into at least one column of the column system;

h) withdrawing a second portion of said high pressure air from a third intermediate location of the exchange line, wherein said second portion is at least a part of the portion of said high pressure air that is remaining after said first portion is withdrawn from said high pressure air, wherein:

1) said second portion constitutes between 50% to 90% of the flow of said high pressure air; and 2) said second portion is withdrawn at a temperature $T_2$, wherein $T_2$ is colder than $T_1$;

i) expanding the second portion of said high pressure air in a Claude turbine to form an expanded second portion;

j) sending the expanded second portion to the medium pressure column; and k) withdrawing a liquid stream from the one of the columns of the column system, pressurizing the liquid stream, and then vaporizing the liquid stream in a heat exchanger, wherein the liquid stream vaporizing in step k) is the same liquid stream vaporizing in step d), wherein said cold booster is mechanically coupled with a drive device, wherein said drive device comprises at least one member selected from the group consisting of an expansion turbine, an electric motor, and combinations thereof.

17. The method of claim 16, wherein the expanded second portion that was expanded in the Claude turbine and sent to the medium pressure column constitutes the sole gaseous air stream sent to the double column.

* * * * *